US006509916B1

(12) United States Patent
Kakinuma et al.

(10) Patent No.: US 6,509,916 B1
(45) Date of Patent: Jan. 21, 2003

(54) PRINTER AND PRINTING METHOD

(75) Inventors: Koichiro Kakinuma, Tokyo (JP); Naoya Kato, Chiba (JP); Tatsuya Deguchi, Kanagawa (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/147,959

(22) PCT Filed: Jul. 28, 1998

(86) PCT No.: PCT/JP98/03362

§ 371 (c)(1),
(2), (4) Date: Aug. 25, 1999

(87) PCT Pub. No.: WO99/06215

PCT Pub. Date: Feb. 11, 1999

(30) Foreign Application Priority Data

Jul. 29, 1997 (JP) ..... 9-203494

(51) Int. Cl.[7] ..... B41J 2/21
(52) U.S. Cl. ..... 347/43; 347/15; 347/100
(58) Field of Search ..... 347/43, 15, 95, 347/100, 12, 40

(56) References Cited

U.S. PATENT DOCUMENTS 4,635,078 A * 1/1987 Sakurada et al. ..... 347/43
4,714,964 A * 12/1987 Sasaki ..... 347/15
4,952,942 A * 8/1990 Kanome et al. ..... 347/43
5,833,743 A * 11/1998 Elwakil ..... 106/31.27

FOREIGN PATENT DOCUMENTS

| | | |
|---|---|---|
| JP | 64-64886 | 3/1989 |
| JP | 2-238990 | 9/1990 |
| JP | 6-246909 | 9/1994 |

* cited by examiner

*Primary Examiner*—Lamson Nguyen
(74) *Attorney, Agent, or Firm*—Rader, Fishman, & Grauer PLLC; Ronald P. Kananen, Esq.

(57) ABSTRACT

A printer device and a picture printing method is disclosed, in which, if the gradation for cyan is to be represented, an ink C' of low concentration is superimposed to represent the low gradation area. This cyan ink is used in combination with a high-concentration blue ink B and a high-concentration green ink G to represent a high gradation area. In representing the high gradation area, the emitting proportions of the high-concentration blue ink B and the high-concentration green ink G are changed to enable the color hue in the high gradation area to be varied delicately to improve color reproducibility.

9 Claims, 11 Drawing Sheets

COLOR HUES IN L* a* b* COLOR SPACE

PRINTER AND PRINTING METHOD

TECHNICAL FIELD

This invention relates to a printer device and a picture printing method. More particularly, it relates to a printer device and a picture printing device in which inks having different color hues in the color space are added in addition to conventional color inks to assure a broader color reproduction gamut.

BACKGROUND ART

Recently, the desk-top publishing, which is creation of documents employing a computer, is used extensively, for example, office environments. There is nowadays an increasing demand not only for letters or graphics, but also for a colored natural pictures, such as photographs, or computer graphics, which are to be output along with letters or figures. Thus it is desired to print natural pictures of high quality or computer graphics, whilst it is strongly desired to directly print the color displayed on a monitor.

In a conventional printer apparatus, employing inks of cyan of low concentration, referred to hereinafter as the low-concentration cyan, cyan of high concentration, referred to hereinafter as the high-concentration cyan, low-concentration magenta, high-concentration magenta, and of high-concentration yellow, a high-concentration ink and a low-concentration ink having the same color (color hue) are superimposed for representing the gradation. It is noted that a low-concentration yellow ink can be omitted because of its low relative luminosity factor. That is, in a conventional printer apparatus, an ink C' of the low-concentration cyan and an ink C of a high-concentration cyan are used and the amount and the ratio of emission thereof are adjusted for representing the cyan gradation. On the left side of FIG. 1, there is shown a droplet of the ink C' emitted to represent the state of the lowest gradation, whereas, on the right side of FIG. 1, there are shown four droplets of the ink C' and three droplets of the ink C emitted to represent the state of the highest gradation.

However, the above-described conventional printer apparatus has a drawback that, even if the gradation can be represented by superposition of the low-concentration ink and the high-concentration ink, the gamut of color reproduction cannot be widened due to the narrow color gamut proper to the ink. For example, in the conventional printer apparatus employing the low-concentration cyan, high-concentration cyan, low-concentration magenta, high-concentration magenta and high-concentration yellow, the gamut of color reproduction that can be represented on a monitor cannot be covered, as may be demonstrated on a L*a*b* color specification chromaticity diagram of FIG. 2, even if these inks are superimposed in combination. The result is that the conventional printer apparatus cannot meet the requirements for directly printing the colors displayed on a monitor, such that optimum results cannot be obtained on printing out high-quality natural pictures or computer graphics.

In view of the above-described status of the art, it is an object of the present invention to provide a printing apparatus and a picture printing method whereby the colors represented on a monitor can be printed clearly by broadening the gamut of color reproduction by gradation representation.

SUMMARY OF THE INVENTION

In the present invention, there is provided a printer device having four or more sorts of color inks, inclusive of high-concentration and low-concentration inks, in which at least three sorts of the inks with different color hues are used as the high-concentration inks, and one or more inks different in color hue in the color space from the above inks are used as the low-concentration inks, these inks being used for picture printing representation.

Specifically, the present invention provides a printer device for printing using at least four sorts of inks having different color hues or concentrations, wherein at least three sorts of high-concentration inks with different color hues and at least one sort of a low-concentration ink different in color hue from any of the high-concentration inks are used for printing.

Preferably, the high-concentration inks are cyan, magenta or yellow inks having different color hues from one another in the color space, or red, green and blue, similarly having different color hues from one another in the color space. The low-concentration ink used is different in color hue in the color space with respect to the aforementioned respective inks.

In the above printer device and picture printing method, the gamut for color reproduction is enhanced by increasing the number of colors of the inks in the high concentration area which is critical in determining the gamut for color reproduction. Specifically, the gradation representation and the color reproduction can be achieved for the high concentration area and the low concentration area by superimposing a high-concentration ink and a low-concentration ink in combination in picture printing representation.

According to the present invention, the colors represented on a monitor can be clearly printed out by broadening the gamut for color reproduction by gradation representation. By superimposing the high-concentration ink and the low-concentration ink in combination, the gamut for gradation representation can be broadened to enable the colors displayed on a monitor to be printed out clearly.

DETAILED DESCRIPTION OF THE PREFERRED EMBODIMENTS

Figure 1:
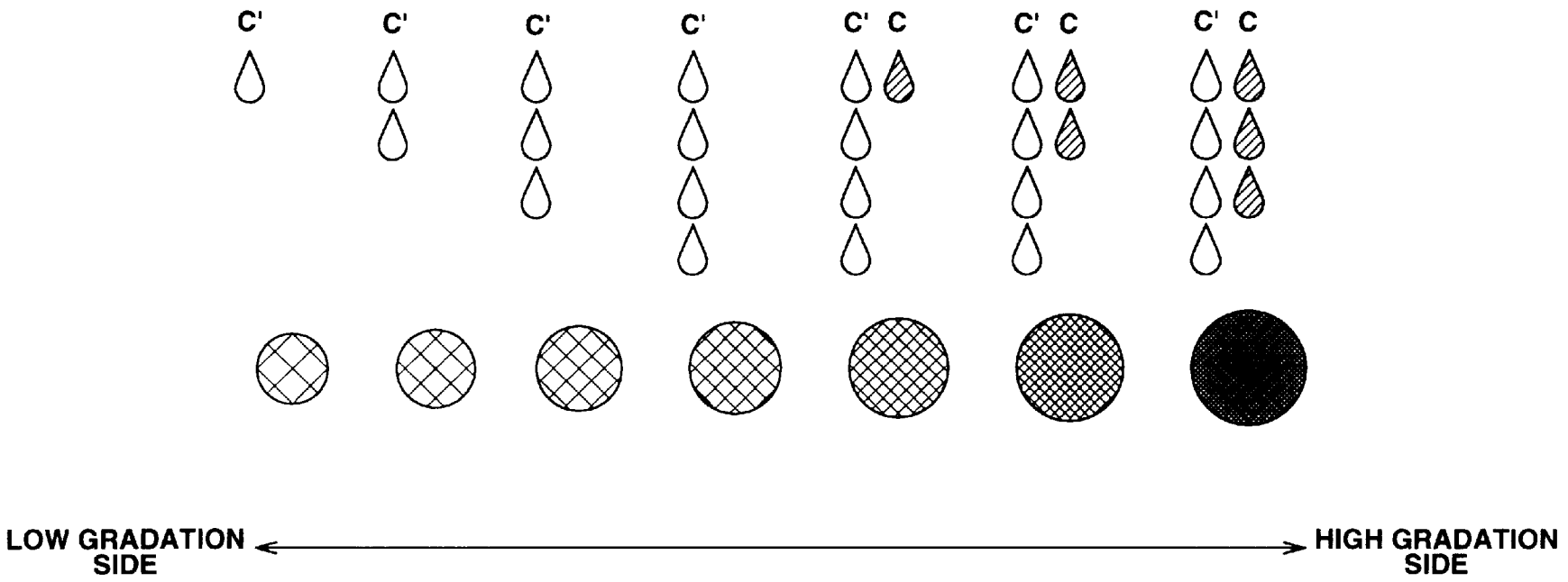
FIG. 1 illustrates a method for representing the gradation in a conventional printer apparatus.
Figure 2:
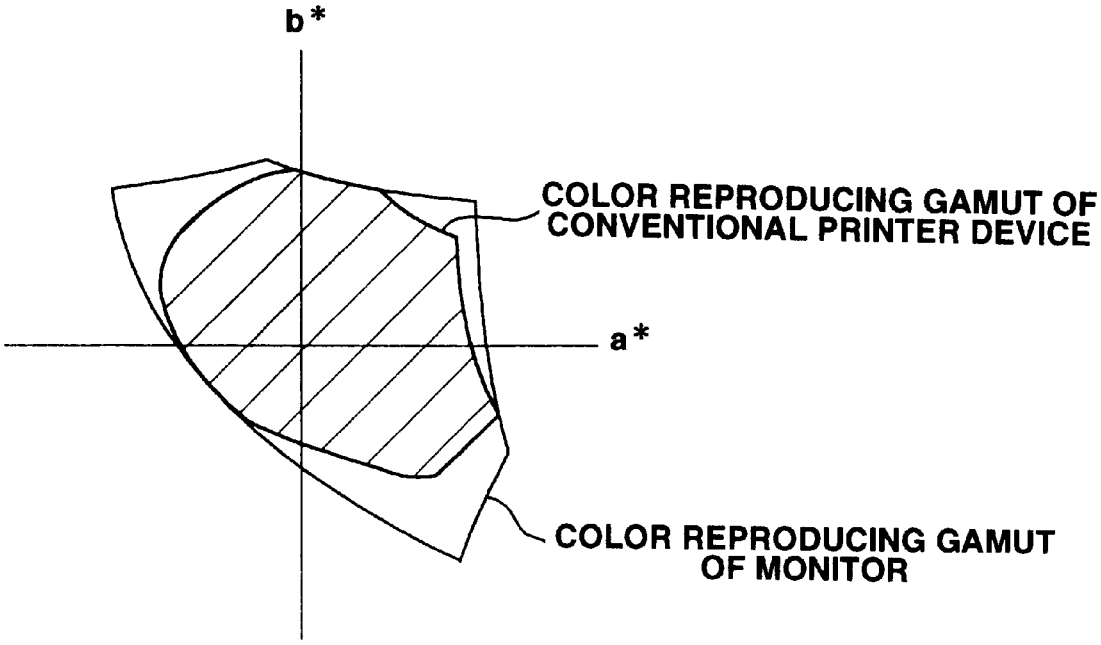
FIG. 2 shows a L*a*b* color specification chromaticity diagram illustrating the gamut of color reproduction of a conventional printer device and that of a monitor for comparison sake.

Referring to the drawings, preferred embodiments of the present invention will be explained in detail.

Figure 3:
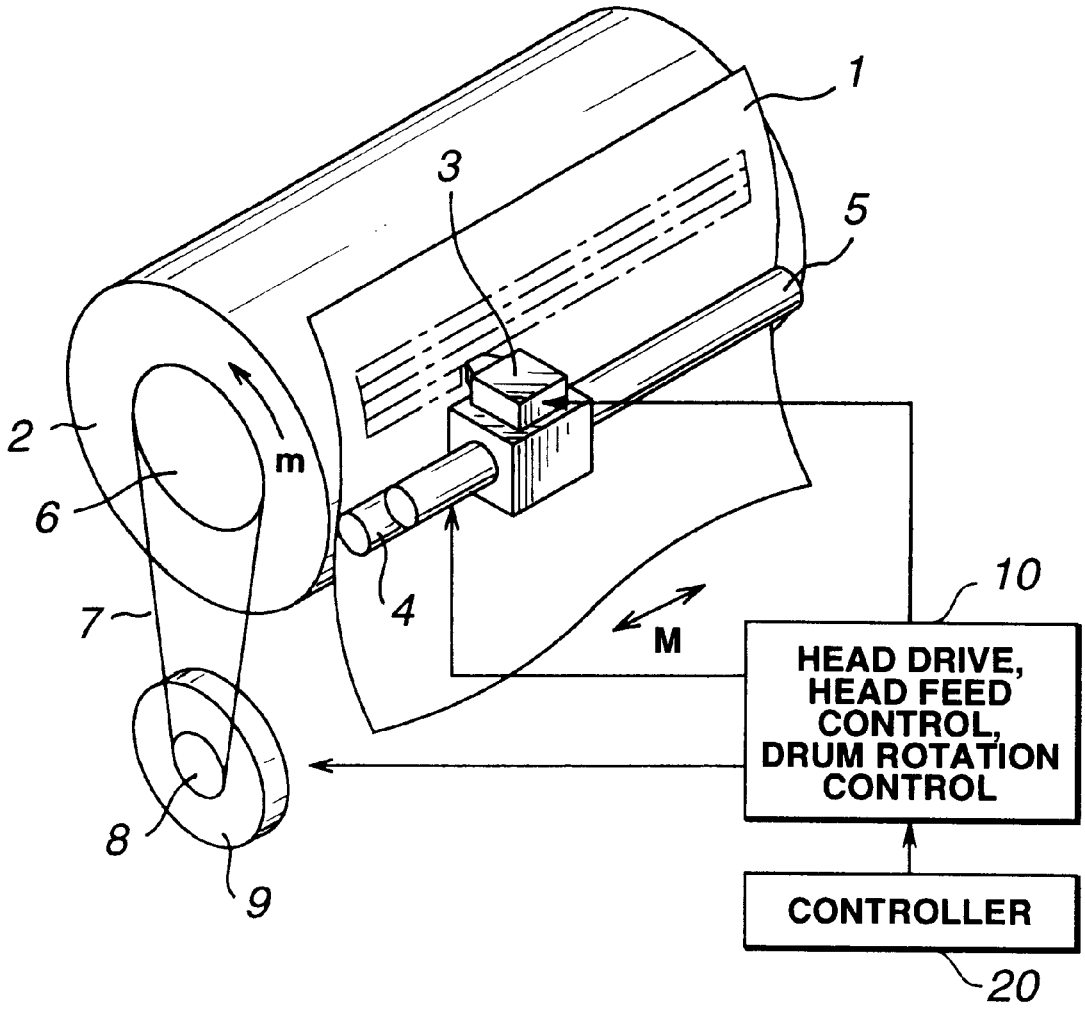
FIG. 3 is a schematic perspective view showing essential portions of an illustrative printer device embodying the present invention.

The present invention is applied to a printer device configured as shown in FIG. 3. This printer device is a so-called serial type printer device and is made up of a drum 2 carrying a printing sheet 1 as a material for printing, a printing head 3 for recording on this printing sheet 1, a feed screw 5 having a screw slot formed therein for causing movement of the printing head 3 and a motor 9 for causing rotation of the drum 2. The printer device also includes a controller 20 for controlling rotation of the drum 2, feed of the head 3 and printing of letters or pictures on the printing sheet 1. The letter or picture printing is referred to hereinafter simply as picture printing.

The printing sheet 1 is adapted for being pressed against and held by the drum 2 by a paper sheet pressing roll 4 mounted parallel to the axis of the drum 2. In the vicinity of the outer peripheral surface of the drum 2 is mounted the feed screw 5 for extending parallel to the axis of the drum 2. The feed screw 5 carries the printing head 3. That is, the printing head 3 is adapted to be moved axially of the drum 2 as indicated by arrow M in FIG. 3. For producing movement of the printing head 3 of the printing head 3 axially of the drum 2, a timing belt or a stepping motor, for example, may be used in place of the feed screw 5.

The printing head 3 in the present embodiment is fed with inks so that it can emit cyan and magenta as the low-concentration inks and also can emit yellow, green, red and blue as the high-concentration inks. By emitting these inks at various proportions, letters, figures, natural color pictures or graphic pictures displayed on a monitor can be printed on the printing sheet 1. In the printing head 3 is enclosed a picture printing head 28 for emitting these inks to the printing sheet 1 to effect picture printing.

The drum 2 is run in rotation by the motor 9 via pulley 6, belt 7 and pulley 8 in the direction indicated by arrow m in FIG. 3. The rotation of the feed screw 5 and the motor 9 and the movement of the motor 9 are controlled on the basis of picture printing data and control signals from the controller 20 which will be explained subsequently in detail. This realizes various control operations for head driving, head feed or drum rotation of the printer device. Specifically, when the printing head 3 is moved to effect picture printing for one row, the drum 2 is rotated by one row to effect next picture printing. For picture printing, the printing head 3 may be moved in one direction or in the reciprocating directions.

Figure 4:
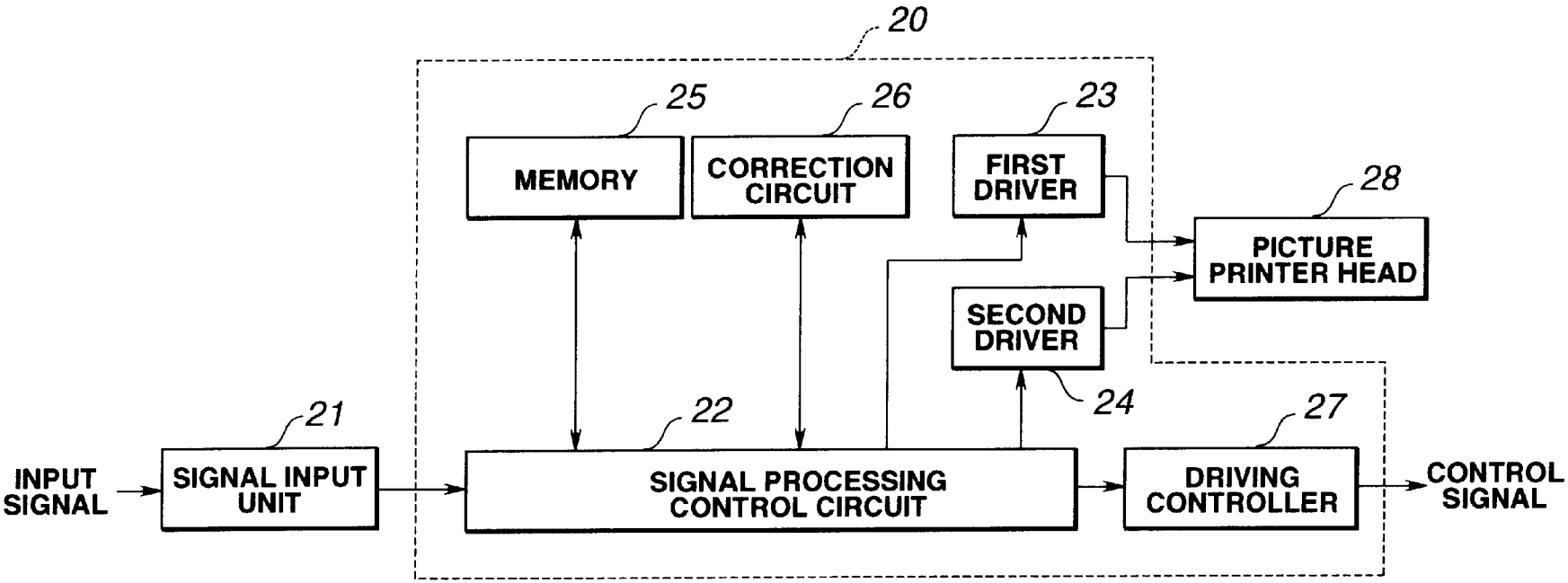
FIG. 4 is a block diagram showing the structure of a picture printing and control system of the printer device shown in FIG. 3.

FIG. 4 shows a block diagram for the picture printing and control systems in the printer device. Referring to FIG. 4, the printer device includes a controller 20, made up of a signal processing control circuit 22, a first driver 23, a second driver 24, a memory 25, a correction circuit 26 and a driving controller 27, and a signal input unit 21 for feeding an input signal supplied from an external block to the controller 20. The printer device also includes a picture printing head 28 enclosed in the printing head 3.

The signal processing control circuit 22 includes a CPU and a DSP (digital signal processor) for controlling respective blocks. The signal processing control circuit 22 is in operation based on input signals sent via a signal input 21 from an external block, such as a personal computer, not shown, or performs preset processing on these input signals. These input signals include letter printing data, picture printing data, operating signals and external control signals.

The input signals, processed by the signal processing control circuit 22, are sent to the driving controller 27 which outputs various control signals based on these input signals, and performs control operations, such as driving or synchronization of the motor 9, for rotationally driving the drum 2, feed screw 5 or the timing belt, shown in FIG. 3, cleaning of the printing head 3 and for effecting supply/discharge of the printing sheet 1.

The first driver 23 and the second driver 24 drive the picture printing head 28 and take charge of picture printing of the entire gradation range (low gradation area and the high gradation area) and picture printing of the high gradation area, respectively.

The memory 25 is used to store picture printing data etc., transiently in view of the picture printing sequence at the time of driving the picture printing head 28, and is constituted by a line buffer memory or a frame memory.

To the signal processing control circuit 22 is connected a correction circuit 26, as shown in FIG. 4. This correction circuit 26 performs control for γ-correction, color correction and for correction of fluctuations from one head to another. In general, the correction circuit 26 stores predetermined correction data as a ROM (read-only memory) map and is adapted to retrieve the correction data responsive to external conditions, such as nozzle number, temperature or input signals.

Figure 5:
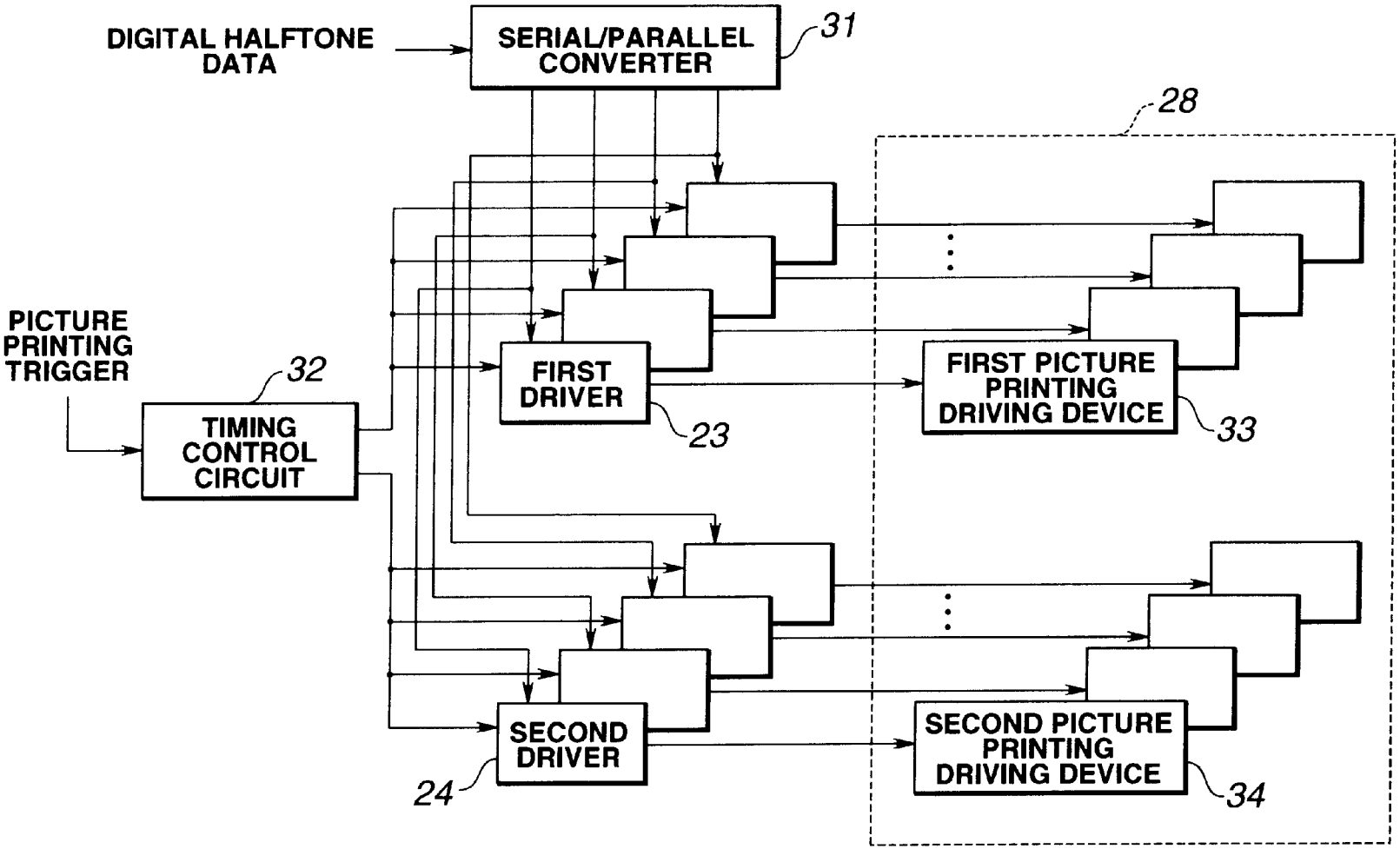
FIG. 5 is a block diagram showing the structure of a picture printing head and a driving device of the printer device shown in FIG. 3.

The structure of the picture printing head 28 and its driving circuit are shown in FIG. 5, from which it is seen that a plurality of first picture printing driving elements 33 for picture-printing the full gradation area and a plurality of second picture printing driving elements 34 for picture-printing the high gradation area are provided in the picture printing head 28. The first driver 23 driving-controls the first picture printing driving elements 33, whilst the second driver 24 driving-controls the second picture printing driving elements 34. That is, in the present embodiment, the picture printing driving elements 33, 34 are of the so-called layered type and the number of the first driver 23 and that of the second driver 24 are set so as to be equal to the numbers of the picture printing driving elements 33, 34.

The drivers 23, 24 driving-control the picture printing driving elements 33, 34 under control by a serial-parallel converting circuit 31 and a timing control circuit 32 provided in the signal processing control circuit 22. These picture printing driving elements 33, 34 are each adapted to emit a dot of the high-concentration ink and/or the low-concentration ink.

In more detail, in the present printer apparatus, the input signals from an external block are sent via signal input unit 21 to the signal processing control circuit 22 of the controller 20. The picture printing data are sorted in the picture printing sequence in the signal processing control circuit 22 to generate serial digital half-tone data. The signal processing control circuit 22 sends the generated digital half-tone data to the serial-parallel converting circuit 31 and, at a picture printing timing, sends a picture printing trigger to the timing control circuit 32.

The serial-parallel converting circuit 31 converts the input serial digital half-tone data into parallel data and routes the as-converted digital half-tone data to each of the first driver 23 and the second driver 24. If, at the time of conversion of the digital half-tone data, the converted digital half-tone data are not higher than a preset threshold for switching between the low gradation side and the high gradation side, the serial-parallel converting circuit 31 does not send data to the second driver 24 taking charge of the high gradation side.

The timing control circuit 32 actuates each of the first driver 23 and the second driver 24 at a preset timing in accordance with the input picture printing triggers. This causes each of the first driver 23 and the second driver 24 to driving-control the associated picture printing driving elements 33, 34.

The picture printing sequence differs with different structures of the picture printing head 28 and the picture printing unit. The pictures are transiently recorded in the memory 25 and retrieved therefrom when the necessity arises given the relation of the picture printing sequence with the inputting sequence of the picture printing data. If there are an extremely large number of nozzles of the multi-head, it suffices if an IC is loaded on the picture printing head 28 to decrease the number of interconnections to the picture printing head 28.

Figure 6:
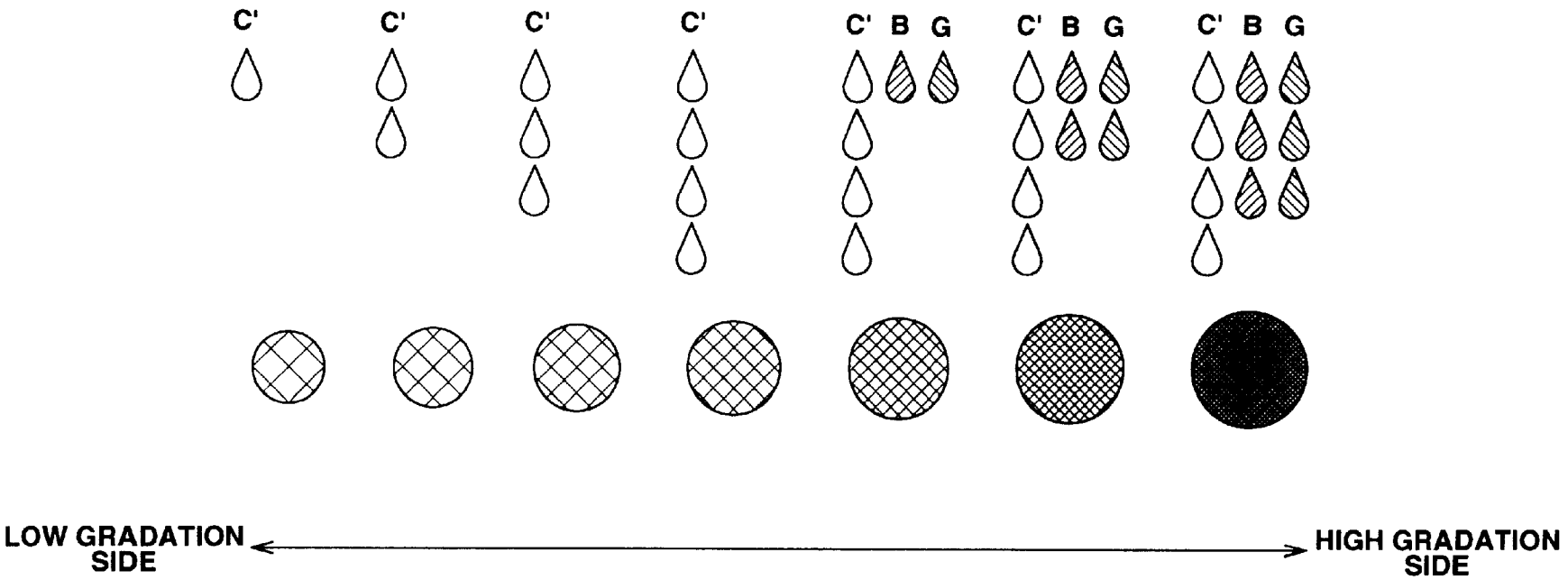
FIG. 6 illustrates the method for gradation representation employing the high-concentration ink and the low-concentration ink by the printer device shown in FIG. 3.

Referring to FIG. 6, the method for picture printing by this printer device is explained. If, in this printer device the gradation for cyan, for example, is to be represented, the ink C' of the low-concentration cyan is superimposed to represent the low gradation area, as shown on the left side of FIG. 6. On the other hand, the high-concentration blue ink B and the high-concentration green ink G are added to the ink C' to represent the high gradation area, as shown on the right side of FIG. 6. This gives the results comparable to those obtained when the cyan gradation is represented using the low-concentration cyan ink C' and the high-concentration cyan ink C in the conventional printer device as shown in FIG. 1. If, in the representation of the high gradation area, the emission proportion of the high-concentration blue ink B and the high-concentration green ink G is varied, the color hue in the high gradation area can be changed delicately to improve color reproducibility.

For gradation representation for magenta, the low gradation area and the high gradation area can be represented by superimposing the low-concentration magenta ink and by adding the high-concentration red ink and the blue ink B to the above blue ink to achieve the result comparable to the above result.

For gradation representation for yellow, the low gradation area and the high gradation area can be represented by superimposing the high-concentration yellow ink and by adding the high-concentration green ink G and the red ink to the above blue ink to achieve the result comparable to the above result. Since yellow has a low relative luminosity factor, the low gradation area can be represented without so-called graininess even on superimposing the high-concentration ink.

For gradation representation for blue, the low gradation area is represented using the low-concentration magenta ink and the low-concentration cyan ink C' , while the high gradation area is represented by using only the high-concentration blue ink B or by adding the low-concentration magenta ink and the above cyan ink C' to the high-concentration blue ink B. This prohibits graininess otherwise produced on superimposing only the high-concentration blue ink B to represent the low gradation area.

Similarly, for gradation representation for green, it is sufficient if the low gradation area is represented using the low-concentration cyan ink C' and the high-concentration yellow ink, while the gradation for the high gradation area is represented using only the high-concentration green ink or the combination of the above cyan ink C' and the above yellow ink with the above high-concentration green ink.

Similarly, for gradation representation for red, it is sufficient if the low gradation area is represented using the high-concentration yellow ink C' and the low-concentration magenta ink and if the gradation for the high gradation area is represented using only the high-concentration red ink or using the combination of the high-concentration red ink with the above yellow color ink and the low-concentration magenta ink.

Figure 7:
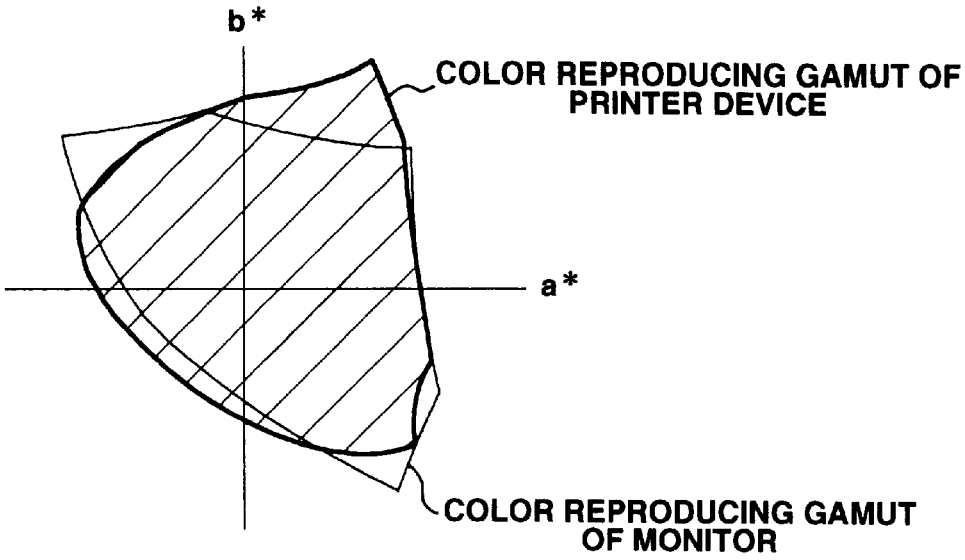
FIG. 7 shows a L*a*b* color specification chromaticity diagram showing the gamut of color reproduction in case of printout by the printer device shown in FIG. 3 and that of a monitor for comparison sake.

In the printer apparatus according to the present invention, the color space that can be represented can be broadened by using inks having different color hues in the color space for color representation. That is, with the conventional printer apparatus employing the low-concentration cyan, low-concentration magenta, high-concentration cyan, high-concentration magenta and high-concentration yellow, only a narrow gamut for color reproduction is achieved as compared to the gamut for color representation on a monitor, whereas, with the use of the above-described picture printing method by the printer apparatus of the present invention employing the low-concentration cyan, low-concentration magenta, high-concentration blue, high-concentration green, high-concentration red and high-concentration yellow, the gamut for color reproduction is almost as broad as that on a monitor, as shown in FIG. 7. This enables clear printout of the high-quality natural picture or computer graphics represented on the monitor.

Figure 8:
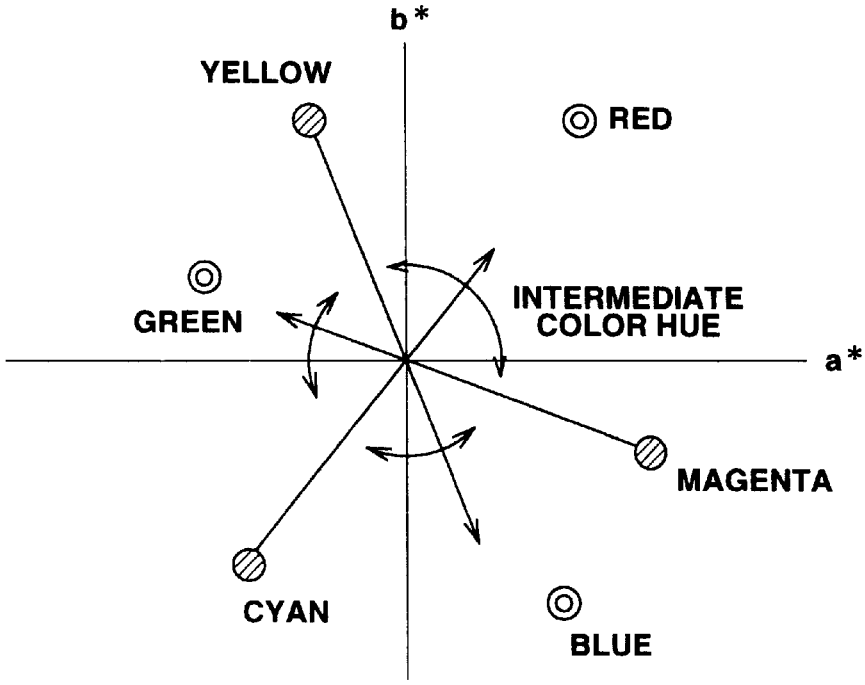
FIG. 8 shows a L*a*b* color specification chromaticity diagram for illustrating the types of inks used in the printer device shown in FIG. 3.

Although the inks used in the above embodiment are the low-concentration cyan, low-concentration magenta, high-concentration blue, high-concentration green, high-concentration red and high-concentration yellow, the present invention is not limited thereto. For example, the yellow ink used may be of the low concentration. As for the inks of blue, green and red, these may be of any suitable colors of the color hues intermediate between the cyan and magenta, between yellow and cyan and between magenta and yellow, as shown in the L*a*b* color specification chromaticity diagram of FIG. 8. Of course, the inks of cyan, magenta and yellow may be of any suitable color intermediate between green and blue, between blue and red and between red and green.

Also, in the present invention, similar effects may be obtained using cyan, magenta and yellow as the high-concentration inks and using red, green and blue as the low-concentration inks. In this case, the inks of cyan, magenta and yellow may be of any suitable color intermediate between the green and blue, intermediate between blue and red and intermediate between the red and green. The reverse also holds good, as described above.

Meanwhile, the inks used in the present invention need not be of six types, it being only sufficient if at least three sorts of the high-concentration inks and at least one low-concentration ink having the color hue different from that of these high-concentration inks in the color space. In the following illustrative experiments, measurements have been conducted of color reproducibility in the printer device shown in FIGS. 3 to 5 in case three sorts of the high-concentration inks, namely cyan, magenta and yellow, are used, and only red, only green and only blue are used as the low-concentration inks, and in case all of the red, green and blue inks are used as the low-concentration inks.

In the present illustrative experiment, C.I. Acid-Blue 9 was used as the dye, and the solvent for this dye having the following composition:

| | |
|---|---|
| (i) ethylene glycol monomethyl ether | 10% |
| (ii) N-methyl-2-pyrrolidone | 10% |
| (iii) water | balance |

was used. The above dye was dissolved in various proportions in the above solvent to prepare inks to measure the relation between the proportion of the dye (dye %) and the optical density (OD). The results are shown in FIG. 9.

In a printer device in general, an ink having an OD value ranging between 1.0 and 2.5 was used as a high-concentration ink, while an ink having an OD value ranging between 0.1 and 1.0 was used as a low-concentration ink.

Figure 9:
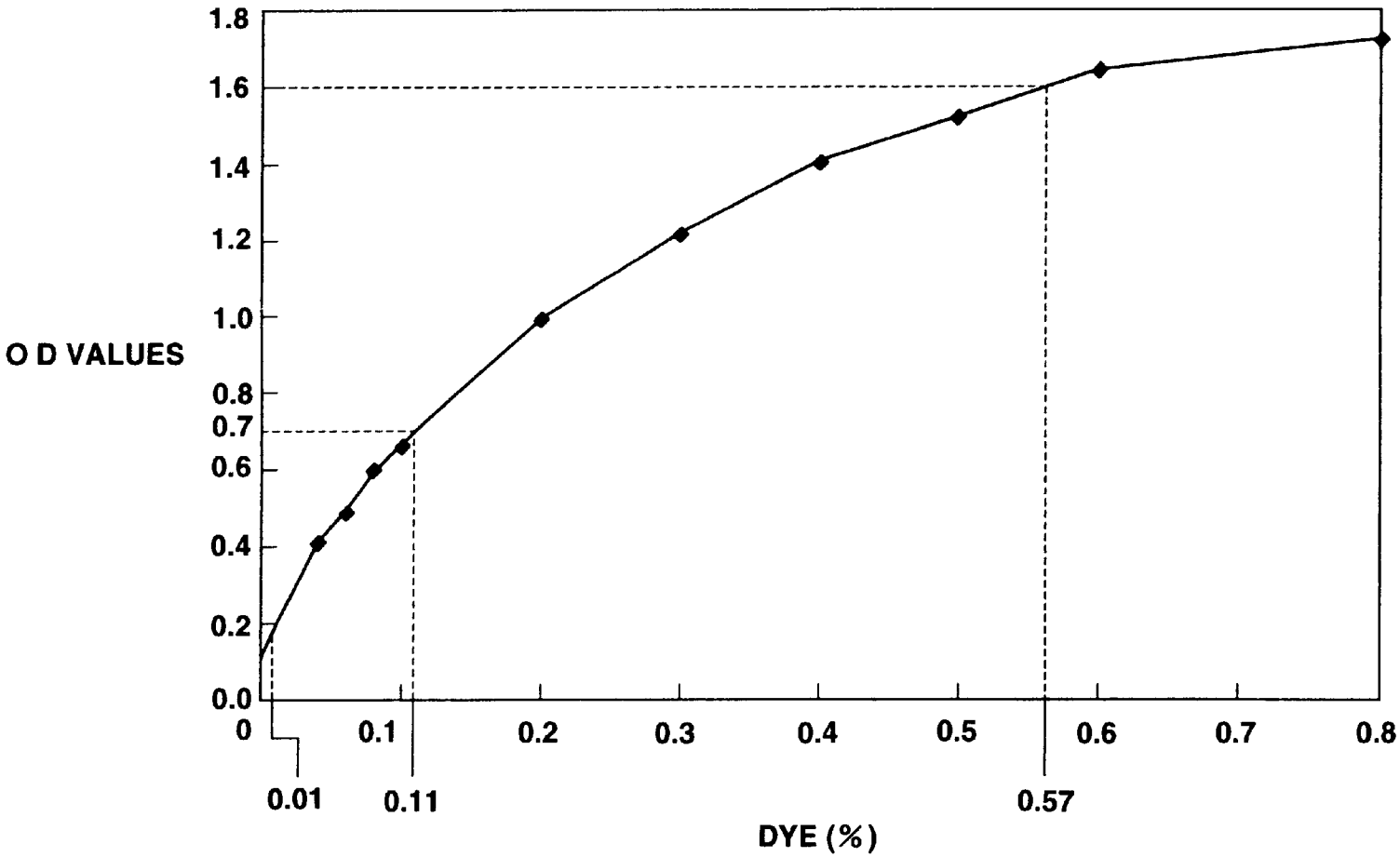
FIG. 9 is a graph showing the relation between measured values of the proportion of the dye in a solvent (dye %) and OD values.

The above experiment indicated that the OD value was 1.6 and 0.7 for approximately 0.57 dye % and for approximately 0.11 dye %, as shown in FIG. 9. An experiment for gradation representation, conducted using the ink with 0.57 dye % and the ink with 0.11 dye % as the high-concentration ink and as the low-concentration ink, respectively, indicated that the OD value was 1.0 and 0.7 for the high-concentration ink to low-concentration ink ratio of 1:2.85 and for the high-concentration ink to low-concentration ink ratio of 1:5.18, respectively. Moreover, the OD value was 0.2 for the high-concentration ink to low-concentration ink ratio of 1:57.

The measured results of the gamut for color reproduction, obtained using only three types of the high-concentration ink of cyan, magenta and yellow on the printer device shown in FIGS. 3 to 5, are shown in FIG. 10A. The measured results of the gamut for color reproduction using the combination of the above high-concentration ink with only red as the low-concentration ink, using the combination of the above high-concentration ink with only green and using the combination of the above high-concentration ink with only blue, are shown in FIGS. 10B, 10C and 10D, respectively.

The measured results of color reproducibility, obtained using the combination of the above high-concentration ink with all of the red, green and blue as the low-concentration inks, are shown in FIG. 10E. An area surrounded by a solid line is the gamut for color reproduction on a monitor, while a hatched area is the gamut for color reproduction of the printer device. The above ink with 0.57 dye % and the ink with 0.11 dye % were used as the high-concentration ink and the low-concentration ink, respectively.

Figure 10:
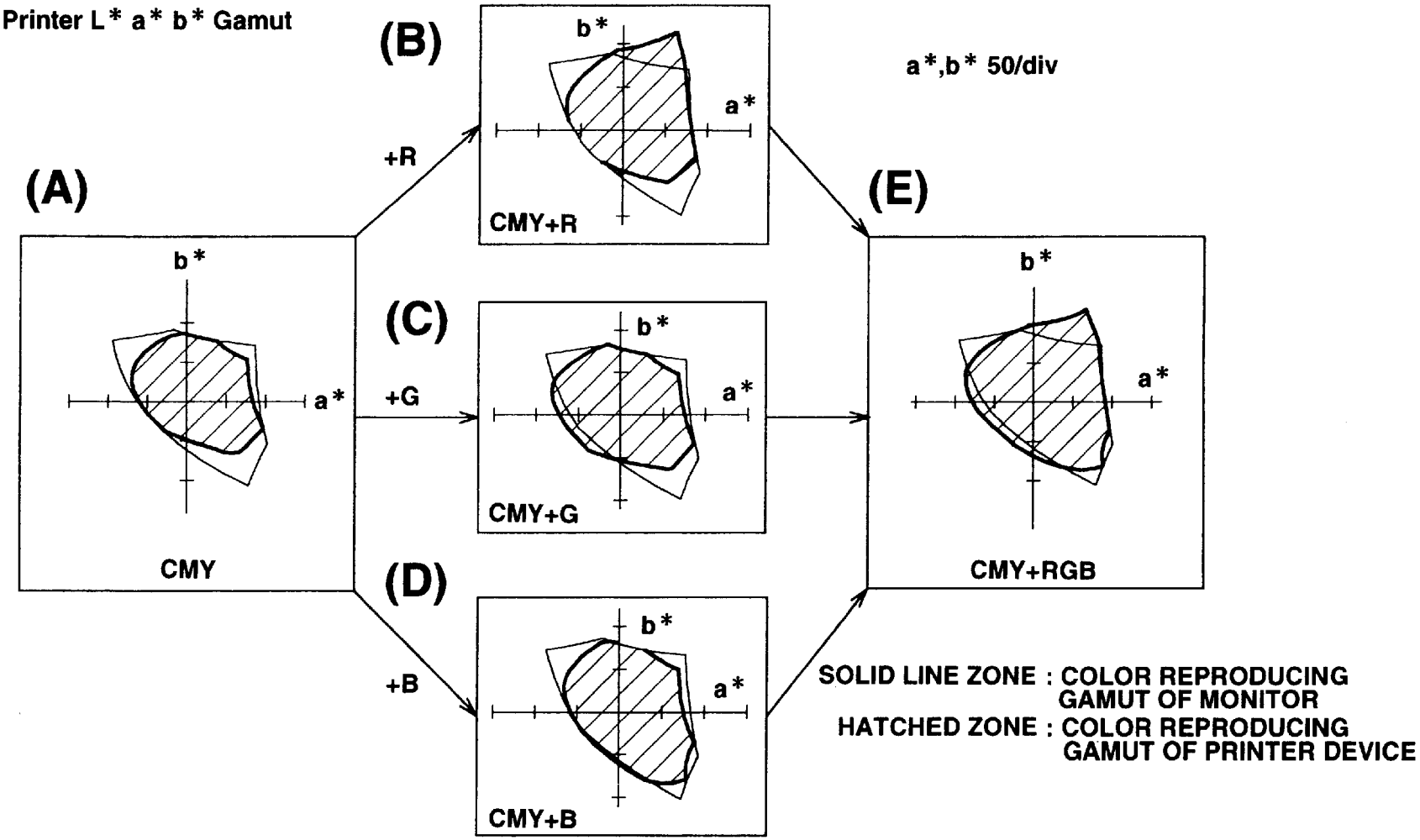
FIG. 10 shows a L*a*b* color specification chromaticity diagram showing measured results of color reproducibility in case three inks, namely cyan, magenta and yellow inks, are used as the high-concentration inks and only red, only green and only blue are used as low-concentration inks in the printer device shown in FIG. 3 and in case all of red, green and blue inks are used as the low-concentration inks in the same printer device.

The results are shown in FIG. 10, from which it is seen that, if only the three types of the high-concentration inks of cyan, magenta and yellow are used, the gamut for color reproduction of the printer device is inferior in any area of the first to fourth quadrants in the L*a*b* color specification chromaticity diagram to the gamut for color reproduction on a monitor, as shown in FIG. 10A. If red is added thereto as the low-concentration ink, the gamut for color reproduction in the first quadrant of the L*a*b* color specification chromaticity diagram is increased, as shown in FIG. 10B, such that the gamut for color reproduction of the printer device vitally surpasses that on the monitor, as shown in FIG. 10B. If green is added as the low-concentration ink to the above high-concentration inks, the gamut for color reproduction is increased in part of the second quadrant and in the third quadrant in the L*a*b* color specification chromaticity diagram such that the gamut for color reproduction surpasses that on the monitor in these areas, as shown in FIG. 10C. If blue is added as the low-concentration ink to the above high-concentration inks, the gamut for color reproduction is increased in part of the third quadrant and in the fourth quadrant in the L*a*b* color specification chromaticity diagram such that the gamut for color reproduction surpasses or is approximate to that on the monitor in these areas, as shown in FIG. 10D. If all of the red, green and blue are added to the high-concentration ink, the gamut for color reproduction of the printer device is almost as broad as that on the monitor, as shown in FIG. 10E.

Although the present embodiment refers to an instance of a serial type printer device, the present invention may also be applied to a line type printer device or to a drum rotation type printer device.

Figure 11:
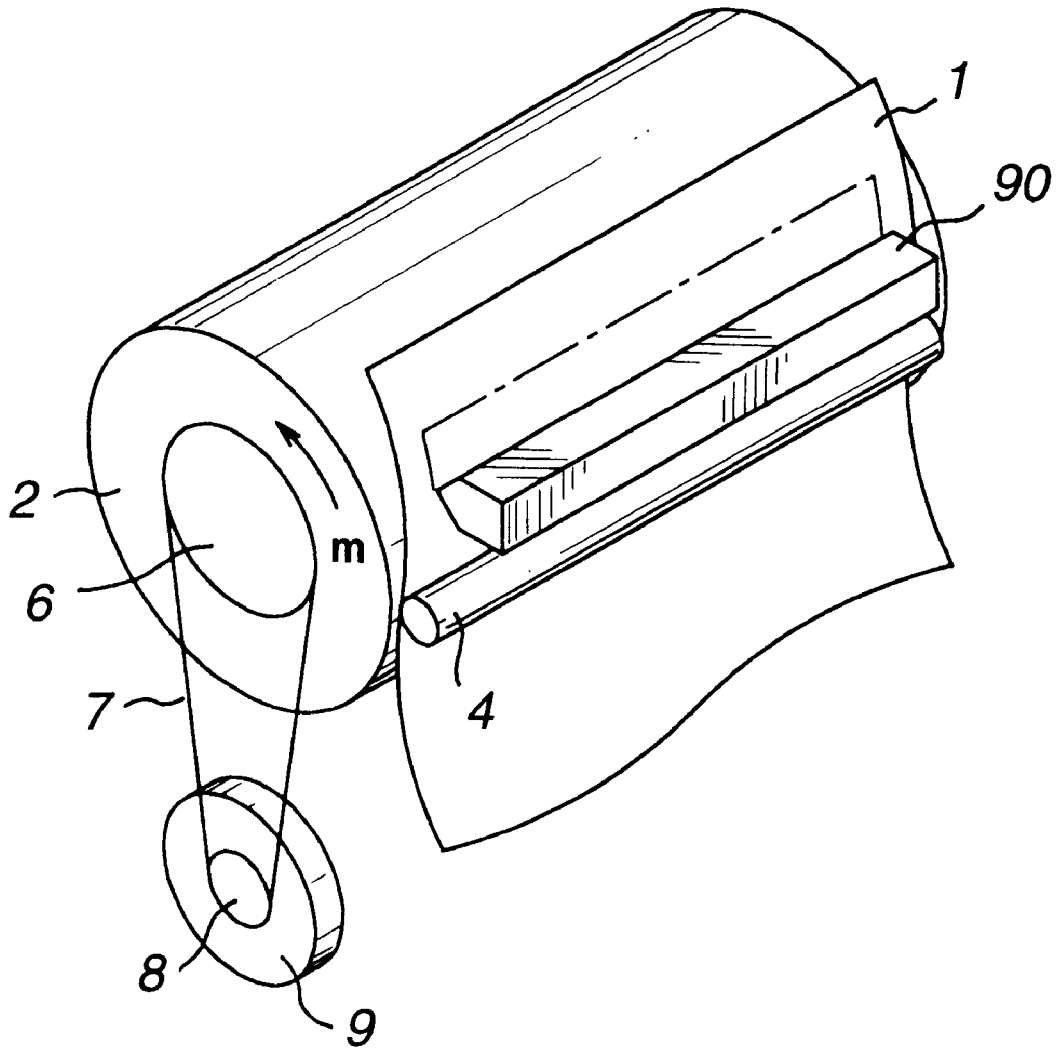
FIG. 11 is a schematic perspective view showing essential portions of a modification of a printer device according to the present invention.

Referring to FIG. 11, an illustrative printer device, to which the present invention may be applied, is explained. In FIG. 11, the parts corresponding to those of the serial type printer device shown in FIG. 3 are indicated by the same reference numerals and the corresponding portions are not explained specifically. The portions of the control system is also not shown in the drawings.

In the line type printer device, a large number of picture printing heads, not shown, are arranged in a line on a line head 90 which is fixed in the axial direction of the drum 2. In this line type printer device, the line head 90 is adapted to perform picture printing simultaneously and, on termination of picture printing for one row, the drum 2 is rotated by one row in the direction indicated by arrow m in FIG. 11 to execute the picture printing for the next row. In this case, printing may be made by any of the methods of effecting picture printing on the entire line collectively, picture printing on plural blocks divided from the entire line or effecting picture printing on alternate rows.

Figure 12:
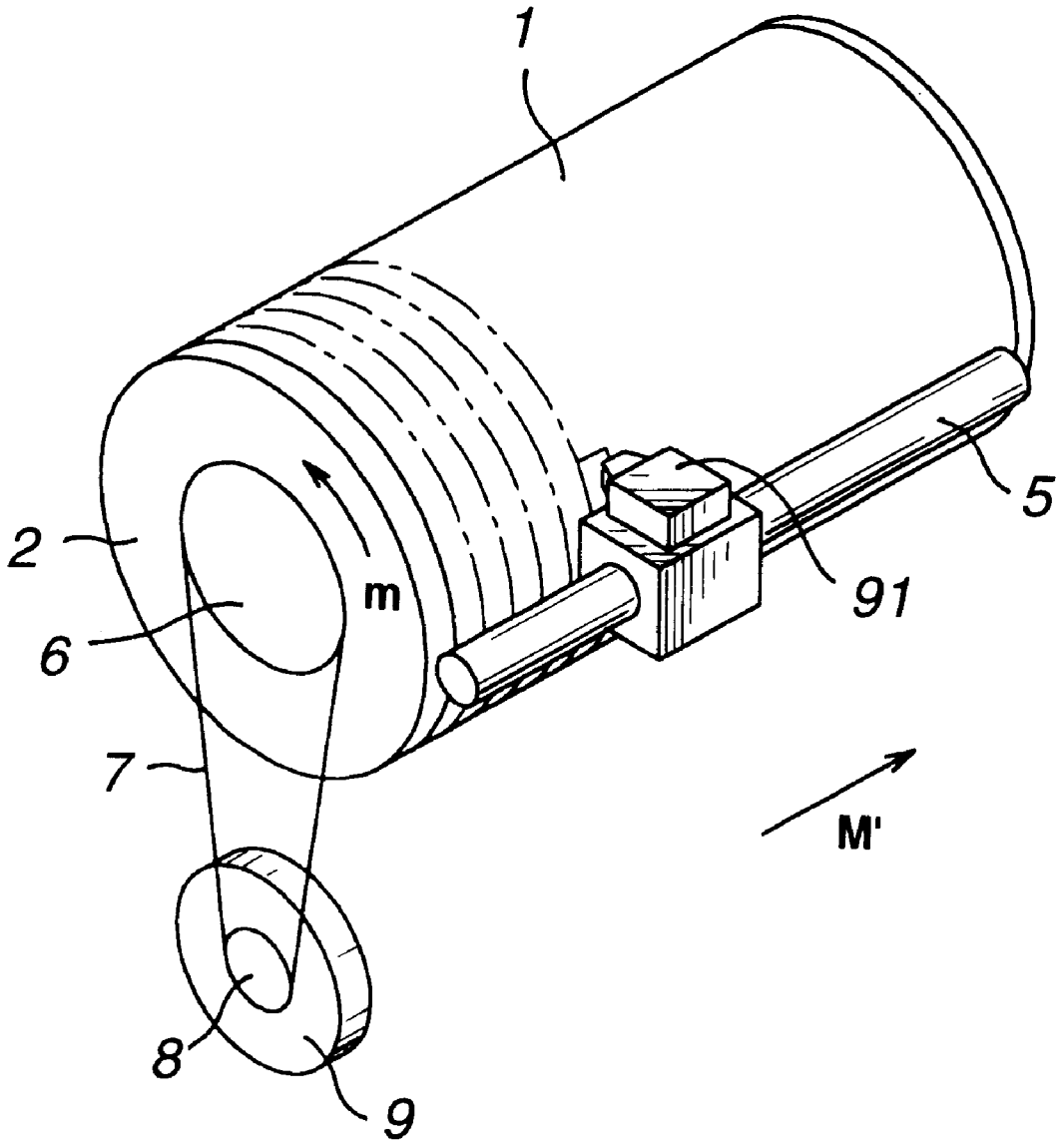
FIG. 12 is a schematic perspective view showing essential portions of another modification of a printer device according to the present invention.

Referring to FIG. 12, parts or components corresponding to those of the serial type printer device shown in FIG. 3 are denoted by the same reference numerals and the corresponding description is omitted for simplicity. Also, the description of the portions belonging to the control mechanism is also omitted for simplicity.

If, in the present drum rotation type printer device, the rum 2 is run in rotation, the high-concentration ink and/or the low-concentration ink are emitted from a printer head 91, in synchronism with the drum rotation, to form a picture on the printing sheet 1. If the drum 2 completes its fall revolution in the direction indicated by arrow m in FIG. 12 to complete picture printing on the printing sheet 1 in the circumferential direction, the feed screw 5 is run in rotation to cause movement of the printer head 91 by one pitch in the direction indicated by arrow M' in FIG. 12 to effect picture printing of the next row. It is also possible to cause rotation of the drum 2 and the feed screw 5 simultaneously to cause progressive movement of the printer head 91.

In the case of a multiple head or of the configuration of performing picture printing on the same location a number of times, the drum 2 and the feed screw 5 are rotated simultaneously in unison to execute spiral picture printing.

In the above-described embodiment, the present invention is applied to a so-called ink jet printer. The present invention, however, can also be applied to any of a fusion transfer printer, a sublimation transcription printer or an electrophotographic printer.

The present invention can also be applied to the combination of the above-described embodiments and can be modified in a wide range without departing form the technical scope of the invention stated in the appended claims.

What is claimed is:

1. A printer device for printing using at least four inks comprising:

a printing ink, wherein said printing ink includes at least three high-concentration inks, each of said at least three high-concentration inks being different in color hue from the other of said at least three high-concentration inks, and at least one low-concentration ink, said low-concentration ink being different in color hue from any of the high-concentration inks, wherein the combination of the high-concentration inks and the low-concentration ink is superimposed at the time of picture printing for gradation representation.

2. The printer device according to claim 1 wherein at least cyan, magenta and yellow are used as said high-concentration inks.

3. The printer device according to claim 1 wherein at least red, green and blue are used as said high-concentration inks.

4. The printer device according to claim 1 wherein the value of the optical density of the high-concentration inks is 1.0 to 2.5.

5. The printer device according to claim 1 wherein the value of the optical density of the low-concentration inks is 0.1 to less than 1.0.

6. The printer device according to claim 1 wherein the gamut for color reproduction on the L*a*b* color specification chromaticity diagram partially surpasses the gamut for color reproduction on a computer graphics monitor.

7. A method for printing using at least four inks comprising the steps of:

supplying to a printer head at least three high-concentration inks, each of said at least three high-concentration inks being different in color hue from the other of said at least three high-concentration inks, and at least one a low-concentration ink, said low-concentration ink being different in color hue from any of the high-concentration inks; and superimposing said high-concentration inks and the low-concentration ink on a picture-printing medium at the time of picture printing for gradation representation.

8. The method for printing according to claim 7 wherein at least cyan, magenta and yellow are used as said high-concentration inks.

9. The method for printing according to claim 7 wherein at least red, green and blue are used as said high-concentration inks.

* * * * *